US006053276A

United States Patent [19]

D'Amico, Jr. et al.

[11] Patent Number: 6,053,276

[45] Date of Patent: Apr. 25, 2000

[54] MUFFLER PACKING METHOD WITH INJECTION OF CARTRIDED CONTINUOUS FILAMENT FIBERGLASS

[76] Inventors: John D'Amico, Jr., 4554 Ash Dr., Nazareth, Pa. 18064; Jeffrey M. Newman, 130 Freedom Ct., Bethlehem, Pa. 18020

[21] Appl. No.: 09/094,327

[22] Filed: Jun. 9, 1998

[51] Int. Cl.[7] ..... F01N 7/18; F01N 3/00

[52] U.S. Cl. ..... 181/243; 141/12

[58] Field of Search ..... 181/243, 252, 181/256, 282; 29/890.08; 141/7, 11, 12

[56] References Cited

U.S. PATENT DOCUMENTS

| | | | |
|---|---|---|---|
| 1,554,534 | 9/1925 | Straussler . | |
| 2,185,584 | 1/1940 | Boyce . | |
| 3,616,143 | 10/1971 | Langlois . | |
| 3,969,171 | 7/1976 | Bolen et al. . | |
| 4,167,986 | 9/1979 | Conway . | |
| 4,309,202 | 1/1982 | Parbhoo . | |
| 4,324,314 | 4/1982 | Beach et al. . | |
| 4,361,423 | 11/1982 | Nitz . | |
| 4,408,679 | 10/1983 | Littrell | 181/243 |
| 4,569,471 | 2/1986 | Ingemansson et al. | 141/11 |
| 4,580,654 | 4/1986 | Fakuda . | |
| 4,589,517 | 5/1986 | Fukuda . | |
| 4,615,717 | 10/1986 | Neubauer et al. . | |
| 4,673,058 | 6/1987 | Roberts et al. . | |
| 4,700,806 | 10/1987 | Harwood . | |
| 4,759,423 | 7/1988 | Harwood et al. . | |
| 4,774,985 | 10/1988 | Broadbelt et al. | 141/12 |
| 4,844,722 | 7/1989 | Ebell . | |
| 4,846,302 | 7/1989 | Hetherington . | |
| 4,860,853 | 8/1989 | Moring, III . | |
| 4,947,957 | 8/1990 | Cullen et al. . | |
| 4,955,999 | 9/1990 | Schaefer et al. . | |
| 4,961,769 | 10/1990 | Miller et al. . | |
| 5,036,585 | 8/1991 | Schweinfurth . | |
| 5,143,781 | 9/1992 | Dunbar et al. . | |
| 5,428,194 | 6/1995 | Emrick et al. . | |
| 5,563,385 | 10/1996 | Harwood . | |

*Primary Examiner*—Khanh Dang
*Attorney, Agent, or Firm*—Duane, Morris & Heckscher LLP

[57] ABSTRACT

A loose fiber packing material for a muffler of an internal combustion engine is temporarily confined in a transfer cartridge, having a shape which is substantially complementary or somewhat smaller than the muffler cavity. The transfer cartridge is adapted to receive a pushing device for discharging the loose fiber packing material from the transfer cartridge into the muffler cavity during manufacture of the muffler. The transfer cartridge allows loose fiber packing to be prepacked, shipped and directly transferred to a muffler cavity without the use of molding resins or packaging materials which would otherwise be inserted into the muffler along with the loose fiber packing material and burned away during initial use of the muffler, causing undesirable smoke and odor.

13 Claims, 4 Drawing Sheets

MUFFLER PACKING METHOD WITH INJECTION OF CARTRIDED CONTINUOUS FILAMENT FIBERGLASS

BACKGROUND OF THE INVENTION

1. Field of the Invention

The invention relates to the manufacture of mufflers for the exhaust systems of internal combustion engines using flexible fibrous muffler packing material, preferably long or continuous strand fiberglass. Such fiberglass is preliminarily packed into transfer containers or cartridges for shipping, using a discharge apparatus that fluffs and separates individual filaments from multi-filament continuous strands fed from spools. The packing is ejected from the cartridge at the muffler manufacturing site, into a preformed muffler housing, using a piston or pusher with tines extending through the rear of the cartridge. The packing is compressed and confined in the muffler housing by insertion at the end of the piston stroke of an end seal of preformed packing carried in the cartridge. The cartridges can be disposable but preferably are reusable.

2. Prior Art

Exhaust mufflers, resonators and similar devices (herein collectively termed mufflers) mute the noise produced by the cylinders of an internal combustion engine and can adjust the sound emitted by the engine, according to the "tune" of the muffler. A muffler housing mounted in series with the exhaust flow path defines one or more passageways that communicate via perforations, slots or other openings with internal chambers within the muffler housing. Some of the chambers can be hollow and shaped to obtain a particular resonant effect, but at least one of the chambers to which the exhaust gases are exposed typically is packed with a sound absorbing fibrous muffler packing. In a simple example, a cylindrical external muffler housing surrounds a perforated coaxial through-tube, and the packing is placed in a space between the perforated tube and the external housing. In other examples the flowpath of all or part of the gas is directed through a mass of muffler packing. In any event, as the exhaust passes through the muffler, sound waves vibrate the packing material and are partly absorbed.

There are two basic ways to install the muffler packing. A molded body of packing material having a shape that conforms to the cavity can be made and inserted as a preformed substantially rigid unit. Alternatively, the muffler can be loaded with loose fiber material that is then compressed by the internal and external walls of the muffler to reside in the necessary chambers.

In the case of a molded body of packing, fibers of fiberglass, mineral wool (e.g., basalt) or the like are mixed with a resin and molded to the required shape by curing the resin chemically or with heat. This technique has the benefit that the packing can be handled as a unit, and installation involves simply placing the packing body into position in the housing during assembly. However there are also drawbacks. The resin which holds the shape of the packing burns away over an initial period of use of the muffler. Exhaust from a new muffler may contain smoke from burning resin, or at least may smell noticeably. The presence of the resin also affects the sound or tune of the muffler, which causes the sound of the engine to change as the resin is burned off. Assuming that the muffler is designed for optimal sound in the long run (i.e., after the resin burns off), the sound of a new muffler is relatively inferior.

Mufflers are made in various shapes, sizes and structures. In addition to the familiar cylindrical and oval-cross section configurations, for example, stamped plate mufflers are known wherein flow paths and chambers are defined between formed plates. The chambers in these mufflers are readily capable of various shapes and sizes. Each distinct size and shape requires a corresponding molding apparatus for forming the muffler packing, which can be expensive.

A further drawback of rigidly molded packing is that manufacturing variations occur in dimensions such as width, length, out-of-round and the like, both in the packing body and in supposedly-complementary muffler housings. It is desirable that the packing fit snugly into the cavity provided for it, filling the cavity completely and obstructing possible bypass passages around the packing. However to ensure that the relatively incompressible molded packing will fit easily into place, the body of packing material is generally sized slightly smaller than the cavity. In this way a packing body that is oversized compared to nominal and/or a muffler housing that is undersized, still can be accommodated. This often results in bypass spaces and looseness of the fit.

Dimensional tolerance is not a problem with directly packed loose fibers, because they flexibly conform to the size of the cavity in which they are placed and are generally compressed during installation. Nor do loose fibers have a problem with burning resin. However, loose fibers can be difficult to handle. Loose fibers can become lodged in seams between structural parts of the muffler if assembly includes compressing the fibers between the structural parts. Loose fibers are also difficult to confine in a gas flow path.

Conventional fiberglass as used for much acoustic and thermal insulation consists of short fibers interleaved with one another forming a batt. Short fiber material is often uncomfortable to handle and may cause a scratchy or itchy feeling when the fibers and associated dust are allowed to contact the skin.

Fiberglass fibers can be produced in indefinitely long lengths, and used to weave or knit textiles. It is also known to use long fibers for thermal insulation to address the scratch/itch disadvantage of short fiber batts. When used for insulation the material is sometimes referred to as "continuous" fiber fiberglass. The material is produced initially as a textile material in that during production, glass fibers are collected and are wound on spools in the form of strands or yarns, each having a plurality of coextensive single fibers. The individual fibers can be adhered in the yarn using sizing. Such a material is available, for example, from Owens Corning Fiberglas Corp., Toledo, Ohio, under the trademark Advantex. This textile-like spooled material can be fluffed and separated into generally randomly oriented individual fibers that are each quite long, using equipment that is also available from Owens Corning Fiberglas.

The strands of parallel fibers are fed from the spools to a pneumatic dispensing head having a vortex or venturi structure that swirls compressed air together with the fibers as they are fed along a discharge path. The fibers are whipped, spun and separated by action of the swirling compressed air. The dispensing head discharges an air-impelled stream of loose fibers. The form of the fibers, namely separated and randomly crossed in a volume, is appropriate for use as insulation, muffler packing or the like. The total fiber length and corresponding volume can be closely controlled by metering the length of strand discharged.

Handling continuous strand fluffed fiberglass is not uncomfortable due to scratching and itching problems, but the fluffed material is loose and flowable. Therefore, manipulating a mass of the loose fibers is awkward and inconvenient. It is particularly awkward to stuff a mass of loose fibers into a cavity, to distribute, compress and confine the fibers in the cavity, and to close off the cavity with an end wall or the like without some fibers interfering with the seam between the cavity and end walls. It would be advantageous, rather than stuffing the cavity, to use the capability of a pneumatic dispensing head or the like as described above, at least for discharging fluffed fibers directly into the muffler housings where they are to be confined. The intensity of the stream of air impelling the fluffed fibers can be controlled to control packing density, and the discharge direction oriented as needed to flow and distribute the material into the cavity.

However, obtaining, operating and maintaining a fiber injection production line may entail a cost of some hundreds of thousand dollars. This expense is not justified in a typical muffler production factory. If loose continuous fiber fiberglass is to be otherwise provided to muffler producers by suppliers of fiber or insulation products, it must be packaged. The material could be transferred from a bulk package to the muffler manually, but this is awkward. Alternatively, a plastic or paper bag or similar enclosure can be provided to be installed directly in the muffler cavity, as a shaped resilient body which is compressed into the cavity and at least confines the fibers. This has many of the same drawbacks as resin preformed rigid molded packing. The package material must be burned away in use, thereby altering the muffler tune over time and causing smoke and/or odor.

In commonly owned patent application Ser. No. 08/975,910, filed Nov. 21, 1997, entitled Muffler Packing Method and Apparatus, continuous strand fiberglass is provided in a shaped bag made of an open mesh plastic or fiberglass. The mesh bag avoids the problem of alteration of the muffler's tune and minimizes any smoke or odor because the mesh contains relatively little combustible material. However, such packaging bags present an additional expense in material and manufacturing, and it would be advantageous if the benefits of a package could be obtained without the corresponding drawbacks.

SUMMARY OF THE INVENTION

It is an object of the invention to provide a transfer cartridge and method for packing loose fiber packing material and enabling the material to be transferred directly from the cartridge into a cavity to be packed, especially into the housing of an exhaust muffler.

It is another object of the invention to package muffler packing material in a way that facilitates installation by manual or powered means and that leaves no packaging material in the muffler that might burn or produce an odor in use.

It is also an object to provide a cartridge as described, which confines the loose packing material while admitting a piston or pushing device from the rear, by which the material is discharged forwardly into the cavity, the cavity being for example an elongated annular cavity.

It is a further object to pack and finally to confine the material in the cavity by operation of the piston or pushing device.

It is another object to pack, transfer, inject and confine the packing material in the cavity, at a minimum expense, using a minimum of operations and with no waste of material.

These and other objects are accomplished in the transfer cartridge and pusher device for transferring cartridged loose fiber packing material to a muffler cavity.

The transfer cartridge comprises a pair of at least semi-rigid inner and outer casings and an end wall which together define a cavity of predetermined size. Loose fiber packing material is partly confined in the cavity, namely by discharging loose fiber material into the cavity, which can be economically done at the insulation manufacturer's facility. The cartridge can then be stored and shipped to a muffler manufacturer for installation. A pusher device can be inserted through apertures provided in the end wall to discharge the fiber packing from the transfer cartridge to a complementary muffler cavity.

A method for packaging and installing packing material in a muffler includes providing a cartridge having a size and shape which is substantially complementary with the muffler cavity; packing the cartridge with loose, continuous-fiber packing; and discharging the packing from the cartridge into the cavity.

BRIEF DESCRIPTION OF THE DRAWINGS

The above and other objects, features and advantages of the invention will be apparent from the following description of preferred embodiments and examples in conjunction with the accompanying drawings, wherein.

DETAILED DESCRIPTION OF PREFERRED EMBODIMENTS

Figure 1:
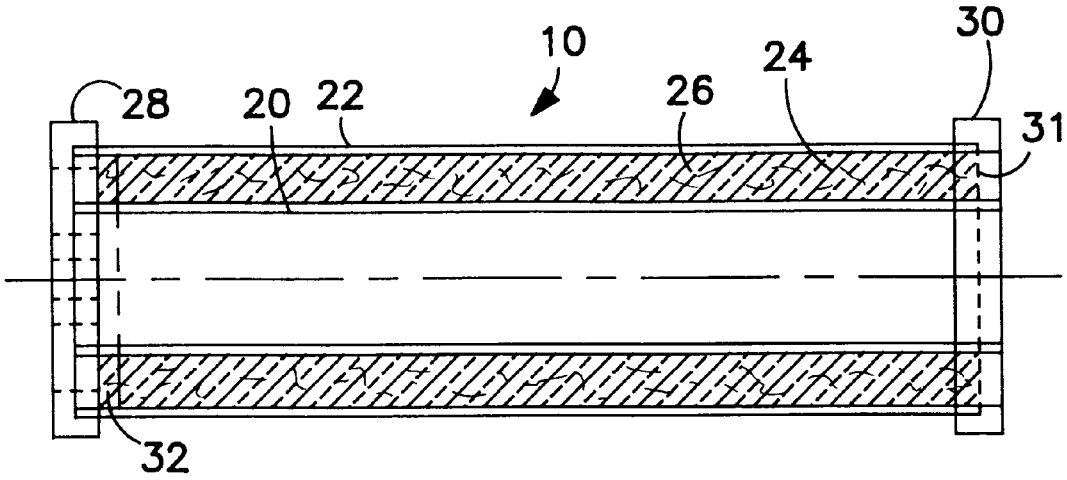
FIG. 1 is a cross-sectional view of a transfer cartridge according to the present invention.

FIG. 1 shows an embodiment of the transfer cartridge 10 according to the invention. The cartridge 10 includes an inner casing 20 and an outer casing 22 which are coaxially aligned and together define an annular cavity 24 for retaining the loose fiber packing 26. The casings are sized such that the defined cavity is substantially complementary to the cavity of a muffler into which the fiber packing will be discharged. Alternatively, the space provided in the cartridge can be somewhat smaller than the space in the muffler, permitting the material to expand to fill the muffler cavity when discharged from the cartridge. While an annular cavity is defined in the embodiment of the transfer cartridge shown in the FIGS. 1–5, it is understood that the transfer cartridge shape can be modified to accommodate a variety of muffler cavity shapes, including irregular cavities defined by plate stamped muffler housings, for example. The casings 20 and 22 can be disposable or reusable and can comprise any sufficiently rigid materials including paperboard, cardboard, plastics, metals and the like.

An end wall 28 is secured on one end of the cartridge 10 to retain the loose fiber packing 26 in annular cavity 24, preferably with some compression. The end wall 20 includes at least one aperture adapted to receive a pushing device for discharging the loose fiber packing 26 through the opposite or discharge end. The discharge end can be provided with a temporary cover when shipping the cartridges to prevent the packing material from expanding through an open discharge end.

Figure 2:
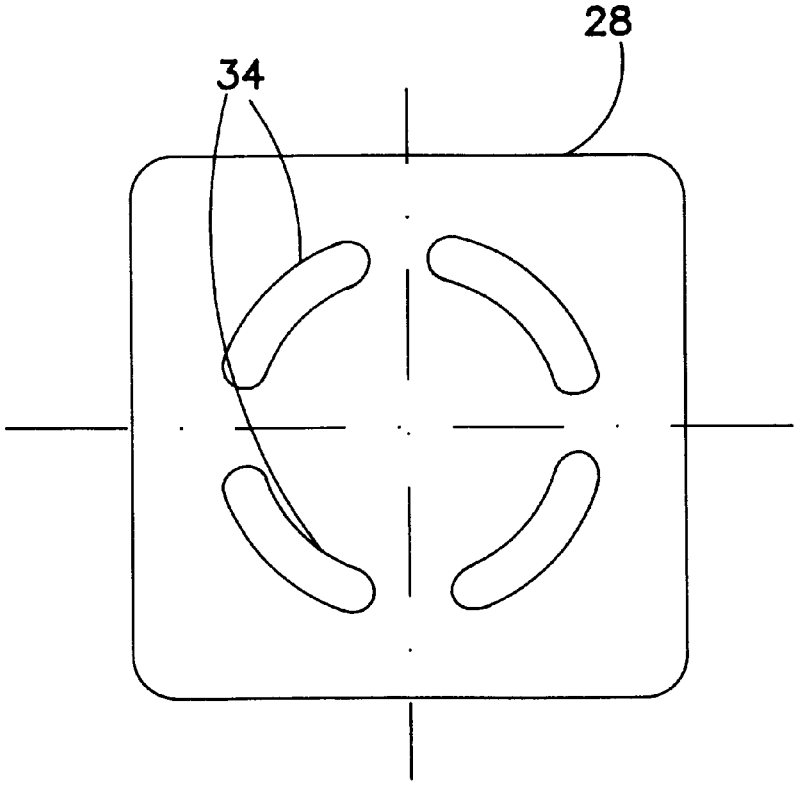
FIG. 2 is an end view of a transfer cartridge according to the invention.

In a preferred embodiment, as shown in FIG. 2, the end wall 28 opposite from the discharge end includes a plurality of symmetrical crescent shaped apertures 34 through which the tines of a pushing device can pass to discharge the packing. The end wall 28 likewise can comprise any suitably rigid materials such as paperboard, plastics and/or metals.

With continued reference to FIG. 1, the transfer cartridge further includes a muffler cavity end seal 32 which is disposed within the transfer cartridge cavity, between the loose fiber packing 26 and end wall 28 opposite from the discharge end. The end seal 32 is discharged along with the fiber packing 26 and confines the fiber packing 26 in the muffler cavity. The end seal also facilitates the discharge of the fiber packing 26 from the transfer cartridge 10 by distributing the load provided by the tines of the pushing device as they extend into the muffler cavity and to some extent around the fiber material discharged into the muffler cavity. The end seal 32 is positively engaged by the rear of the pushing device near the end of the insertion stroke, and pushed into the muffler cavity to close the cavity against expansion of the compressed fiber material. The end seal 32 can be a mineral fiber molded annular disc, such as basalt fiber molded with resin. The resin is prone to burn during the initial period of use of the muffler. However, the amount of resin is small and is confined to the end wall portion of the cavity.

A removable end cap 30 is provided at the discharge opening 31 of the transfer cartridge 10. The end cap 30 confines the loose fiber packing 26 in the filled transfer cartridge 10 for storage and shipment, and can be removed when discharging the fiber packing from the transfer cartridge 10. In the case of a disposable cartridge, a tear-off or hinged paperboard end cap is preferable. However, disposable as well as reusable end caps can be provided in paperboard, plastic, metal foil or the like.

Figure 3:
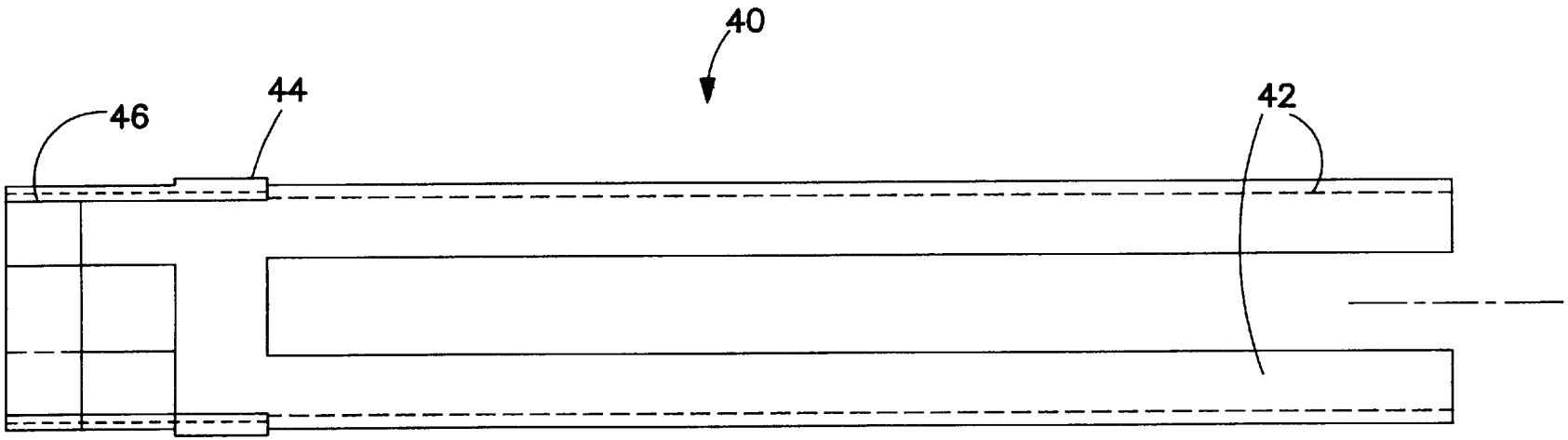
FIG. 3 is a cross-sectional view of a pusher device for use with the transfer cartridge, according to the present invention.
Figure 4:
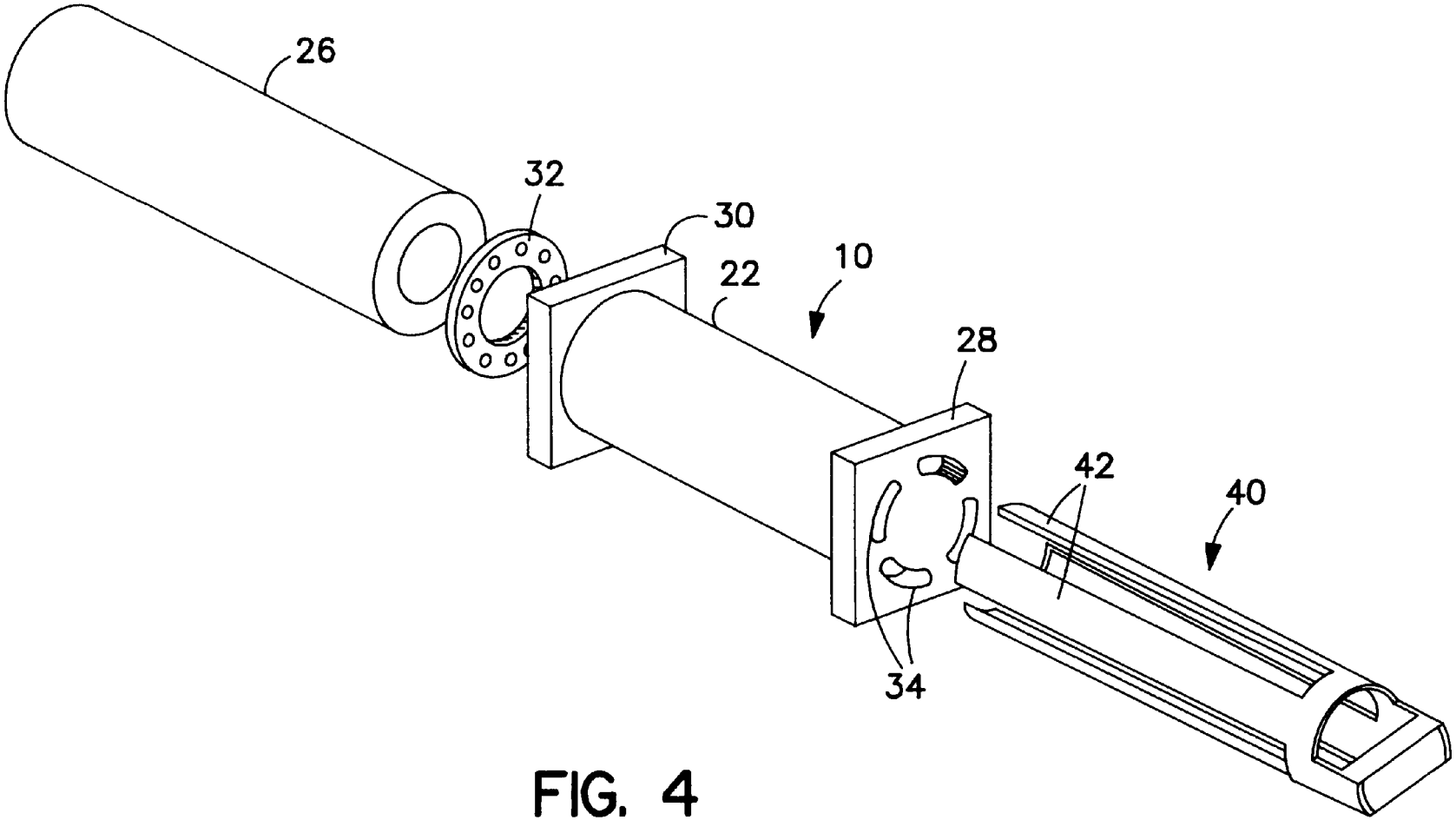
FIG. 4 is an exploded perspective view of a transfer cartridge and pusher device according to the invention.

FIG. 3 shows a pusher device 40 used to discharge the fiber packing 26 from transfer cartridge 10. The pusher 40 can comprise any sufficiently rigid material including, cardboard, plastic or metal, and preferably comprises plastic such as polycarbonate. The pusher 40 in the embodiment shown (for an annular muffler cavity) is a generally cylindrical member having a plurality of tines 42 extending therefrom. The tines 42 are complementary with the apertures 34 provided in end wall 28 such that the tines can pass through the apertures to discharge the fiber packing from the transfer cartridge. The pusher 12 includes a stopper flange 44 which restricts the degree that the pusher tines 42 can be inserted into the transfer cartridge 10 through end wall 28. The flange 44 is positioned with respect to the pusher 40 such that the tines of the pusher 12 will extend through a transfer cartridge 10, seated over a muffler cavity, finally to push the end seal 32 into the end of the muffler cavity. A handle 46 is provided at the proximal end of the pusher shown, to facilitate manual manipulation of the pusher when engaging the transfer cartridge. An automatic pusher, e.g., powered by a pneumatic cylinder or the like, is also possible. An exploded view of the aforementioned transfer cartridge 10 and manual pusher device 40 is shown in FIG. 4.

According to the invention, a transfer cartridge 10 is pre-packed with loose fiber packing material 26. The fiber packing material 26 is packed into the transfer cartridge 10 using a discharge apparatus that fluffs and separates individual filaments from multi-filament continuous strands fed from spools to a pneumatic dispensing head having a vortex or venturi structure that swirls compressed air together with the fibers as they are fed along a discharge path, as described above. The dispensing head discharges an air-impelled stream of loose fibers which are randomly crossed in volume to produce a material suitable for insulation, muffler packing or the like.

The fluffed fibers are injected directly into the cavity of transfer cartridge 10. In some instances, it may be desirable to vary the fiber packing density in the transfer cartridge to accommodate odd muffler shapes and/or differences in cross-sectional dimensions. Localized regions of high density fiber packing can be provided throughout the transfer cartridge cavity by controlled metering of the length and corresponding volume of the injected fibers when filling the transfer cartridge 10. Once the fiber packing is transferred to the muffler, the dense packing expands to fill the irregular cavity.

Figure 5:
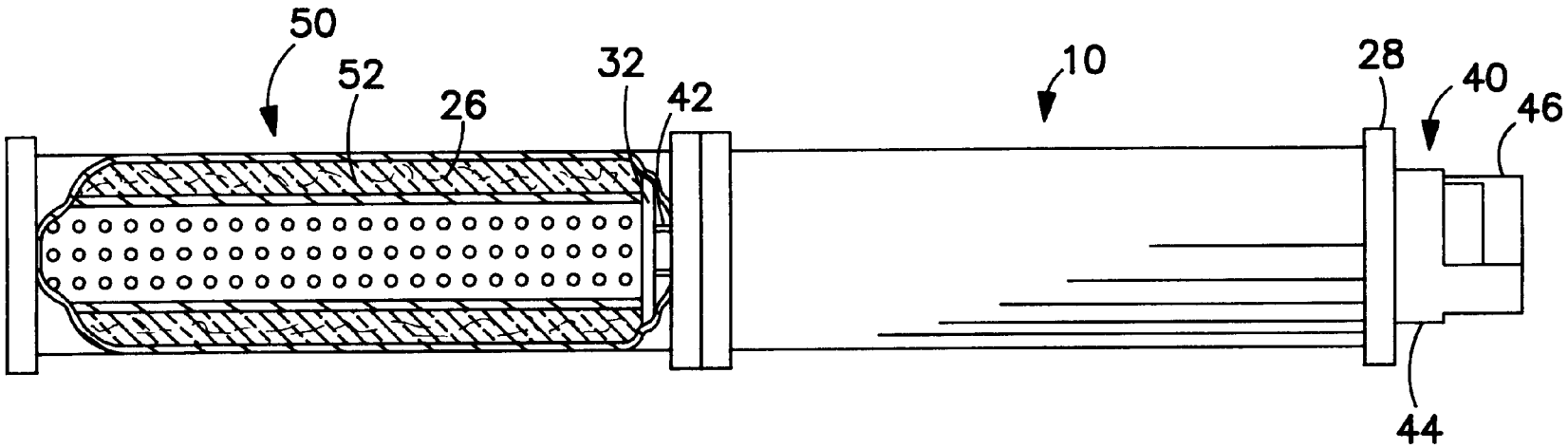
FIG. 5 is an elevation view of a transfer cartridge mounted to a muffler in partial cutaway, wherein a pusher device has been inserted through the end wall of the transfer cartridge to push the end seal and loose fiber packing into the muffler cavity.

FIG. 5 shows an exemplary embodiment of a transfer cartridge 10, aligned with a muffler 50, wherein the tines 42 of a pusher device 40 have been inserted through the end wall of the cartridge 10 to push the end seal 32 and fiber packing 26 into the muffler cavity 52. Manual discharge of the fiber packing 26 from the transfer cartridge 10 into a muffler cavity is effected in the following manner. First, a transfer cartridge filled with fiber packing 26 is provided. The cartridge preferably additionally contains an end seal 32 abutted against the interior of end wall 28, which can be a thin resin molded fiber annular disc, for example about 0.5 inch or one centimeter in axial thickness. The transfer cartridge 10 should have a size and shape that is substantially complementary to a corresponding muffler cavity into which the fiber packing 26 will be transferred, or is slightly smaller to permit expansion of the fiber material upon insertion into the cavity. The end cap 30 is removed from the transfer cartridge 10 to uncover the discharge opening 31. The transfer cartridge 10 is then positioned relative to the muffler so that the respective cavity openings are aligned. A second end seal can be provided at the discharge end of the transfer cartridge is removed immediately prior to aligning the muffler and cartridge. With the cavity openings in communication, the tines 42 of pusher 40 are guided through complementary apertures in the end wall 28 and into the transfer cartridge cavity, pushing the end seal 32 and fiber packing through the discharge opening and into the muffler cavity. The tines of the pusher are inserted through apertures until the stopper flange abuts the end wall 28. When completely inserted, the pusher tines extend sufficiently past the discharge end of the transfer cartridge to seat the end seal 32 in the end of the muffler cavity. After discharging the fiber packing, the pusher is retracted, leaving the end seal secured in place, and the transfer cartridge is removed from the muffler.

The fiber packing 26 can also be pneumatically discharged from the transfer cartridge into a muffler cavity by applying a predetermined quantity of compressed gas to the end wall of transfer cartridge. For pneumatic discharge to operate effectively, the discharge opening should be temporarily sealed to the muffler cavity opening to prevent gas leakage. In addition, perforations can be provided in the muffler cavity walls to prevent backpressure in the muffler cavity which would otherwise inhibit insertion of the fiber packing.

To facilitate the transfer of fiber packing from the transfer cartridge to the muffler cavity the casings 20, 22 of the transfer cartridge 10 are preferably formed from a low friction material and the fibers and/or the interior of surfaces the transfer cartridge 10 can additionally be provided with a low friction coating such as Teflon. To facilitate forward movement of the fiber material by the pusher, the tines can have forward facing serrations or the like, which are ramped rearwardly to facilitate retraction afterwards.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. In combination, a transfer cartridge and a muffler having a cavity of predetermined size and shape, said transfer cartridge comprising:

a pair of coextensive inner and outer casings;

an end wall on the casings; and, a predetermined quantity of loose fiber packing material between the casings;

said casings and end wall together defining a cavity of predetermined size and shape, said loose fiber packing being at least partly confined in said cavity, said cavity having a discharge opening for discharging the loose fiber packing material from said cavity, said end wall further including at least one opening adapted to receive a pushing device for discharging said loose fiber packing material from said discharge opening, wherein the cavity of the transfer cartridge is substantially complementary to the muffler cavity and the loose fiber packing is transferable from the transfer cartridge to the muffler cavity.

2. A transfer cartridge for installing loose fiber packing material in a muffler cavity comprising:

a pair of coextensive inner and outer casings;

an end wall on the casings; and a predetermined quantity of loose fiber packing material, said casings and end wall together defining a cavity of predetermined size, said loose fiber packing being at least partly confined in said cavity, said cavity having a discharge opening for discharging the loose fiber packing material from said cavity, said end cap further including at least one opening adapted to receive a pushing device for discharging said loose fiber packing material from said discharge opening, whereby said loose fiber packing material is transferrable from said transfer cartridge cavity to said muffler cavity.

3. The transfer cartridge of claim 2 wherein said inner and outer casings are elongated tubular casings which are coaxially aligned and said transfer cartridge cavity is annular.

4. The transfer cartridge of claim 2 further including a seal cap disposed within said transfer cartridge cavity, between said end wall and said loose fiber packing.

5. The transfer cartridge of claim 4 wherein said seal cap comprises basalt.

6. The transfer cartridge of claim 2 wherein said loose fiber packing has a varied density in said transfer cartridge cavity.

7. The transfer cartridge of claim 2 further comprising a removable end cap covering said discharge opening of said transfer cartridge.

8. A method for packaging and installing packing material in a cavity having a size and shape, comprising the steps of:

providing a cartridge having a size and shape substantially complementary with that of the cavity;

packing the cartridge with loose continuous-fiber packing; and, discharging the packing from the cartridge into the cavity.

9. The method of claim 8, further comprising placing an end seal into the cartridge before or after said packing of the cartridge, and wherein said discharging of the packing includes discharging the end seal to confine the packing in the cavity.

10. The method of claim 8, further comprising placing an end seal against an end wall of the cartridge before said packing of the cartridge, and wherein said discharging of the packing includes pushing the packing from the cartridge using a pusher passed through the end wall.

11. The method of claim 10, wherein the pusher is structured to engage the end seal at an end of a pushing stroke for discharging the end seal to confine the packing in the cavity.

12. The method of claim 10, wherein the pusher comprises a multi-tined cylindrical form and is operated by passing tines thereof through apertures in the end wall of the cartridge.

13. The method of claim 10, further comprising sealing an open end of the cartridge with a removable seal after said packing step, and removing said removable seal prior to said packing of the cavity.

* * * * *